US012698580B2

(12) United States Patent
Owegeser

(10) Patent No.: US 12,698,580 B2
(45) **Date of Patent: *Aug. 4, 2026**

(54) TUFTING UNIT AND TUFTING MACHINE

(71) Applicant: SMG Sportplatzmaschinenbau GmbH, Voehringen (DE)

(72) Inventor: Johann Baptist Owegeser, Illerrieden (DE)

(73) Assignee: SMG Sportplatzmaschinenbau GmbH, Voehringen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/018,998

(22) Filed: Jan. 13, 2025

(65) Prior Publication Data

US 2025/0146199 A1 May 8, 2025

Related U.S. Application Data

(63) Continuation of application No. 18/584,869, filed on Feb. 22, 2024, now Pat. No. 12,195,902, which is a continuation of application No. 17/415,057, filed as application No. PCT/EP2019/085713 on Dec. 17, 2019, now Pat. No. 11,913,153.

(30) Foreign Application Priority Data

Dec. 19, 2018 (DE) ..... 20 2018 107 291.9

(51) Int. Cl.
*D05C 15/16* (2006.01)
*D05C 15/08* (2006.01)

(52) U.S. Cl.
CPC ..... *D05C 15/16* (2013.01); *D05C 15/08* (2013.01)

(58) Field of Classification Search
CPC ..... D05C 15/08; D05C 15/16
USPC ..... 112/80.71, 80.7, 90.73
See application file for complete search history.

(56) References Cited

U.S. PATENT DOCUMENTS

| | | | | |
|---|---|---|---|---|
| 3,595,185 | A | 7/1971 | Shorrock | |
| 3,756,173 | A | 9/1973 | Shorrock | |
| 3,937,158 | A | 2/1976 | Spanel | |
| 5,481,991 | A | 1/1996 | Geerts | |
| 5,983,815 | A | 11/1999 | Card | |
| 8,181,585 | B1 | 5/2012 | Samilo | |
| 9,410,276 | B2 | 8/2016 | Hall | |
| 11,913,153 | B2 | 2/2024 | Owegeser | |
| 12,195,902 | B2 * | 1/2025 | Owegeser | D05C 15/16 |
| 2014/0331906 | A1 | 11/2014 | Hall | |
| 2022/0064835 | A1 | 3/2022 | Owegeser | |

FOREIGN PATENT DOCUMENTS

| | | | |
|---|---|---|---|
| CN | 108660630 | A | 10/2018 |
| CN | 113330152 | A | 8/2021 |
| DE | 202016102177 | | 7/2016 |
| DE | 102015112329 | | 2/2017 |
| DE | 202016106988 | | 4/2018 |
| DE | 202016106988 | U1 | 4/2018 |

(Continued)

*Primary Examiner* — Danny Worrell
(74) *Attorney, Agent, or Firm* — Loginov & Associates, PLLC; William A. Loginov

(57) ABSTRACT

The invention relates to a tufting unit for a tufting machine, wherein a yarn transport gripper positions yarn strands which after cutting thereof are used by insertion elements. Furthermore, the invention relates to a tufting unit having such a tufting machine.

18 Claims, 11 Drawing Sheets

(56) References Cited

FOREIGN PATENT DOCUMENTS

| | | | |
|---|---|---|---|
| DE | 202018107291 | U1 | 3/2020 |
| RU | 2501896 | | 12/2013 |
| SU | 128278 | | 11/1959 |
| WO | 199308332 | | 4/1993 |
| WO | 2013029121 | | 3/2013 |
| WO | 2017017237 | | 2/2017 |
| WO | 2017017237 | A1 | 2/2017 |
| WO | 2017183977 | | 10/2017 |
| WO | 2017183977 | A1 | 10/2017 |
| WO | 2020127313 | A1 | 6/2020 |
| WO | 2022223538 | A1 | 10/2022 |

* cited by examiner

TUFTING UNIT AND TUFTING MACHINE

FIELD OF INVENTION

The invention relates to a tufting unit for a tufting machine as well as to a tufting machine having such a tufting unit.

BACKGROUND OF INVENTION

Tufting machines typically serve for inserting portions of yarn strands into a substrate, wherein this in most instances takes place in such a manner that one respective part of said yarn strands is fixedly received in the substrate and one part protrudes upward. On account thereof, an artificial turf can be configured, for example, as is used on various sports grounds, for example on soccer pitches.

Tufting machines are typically used herein in order for large pitches or grounds which are to be provided with an artificial turf to be processed. It is accordingly important that a tufting machine has an ideally high production rate when inserting yarn portions. High reliability is likewise important since any comparatively long downtime for carrying out repair work in a planned deployment can rapidly lead to time schedules being significantly disrupted.

It is therefore an object of the invention to provide a tufting unit for a tufting machine which has proven particularly efficient and reliable. It is furthermore an object of the invention to provide a tufting machine having such a tufting unit.

SUMMARY OF THE INVENTION

This is achieved according to the invention by a tufting unit and a tufting machine as claimed in the respective independent claims. Advantageous design embodiments can be derived from the respective dependent claims, for example.

The invention relates to a tufting unit for a tufting machine.

The tufting unit has a yarn infeed installation for simultaneously feeding a number of yarn strands in parallel.

The tufting unit has at least one insertion element.

The tufting unit has a yarn transport gripper which is configured for transporting a respective free end of the yarn strands away from the yarn infeed installation such that each insertion element is in each case assigned one yarn strand.

The tufting unit has a cutting unit which is configured for cutting the yarn strands such that, of each yarn strand assigned to an insertion element, one yarn portion that is assigned to the respective insertion element remains.

Each insertion element is configured for inserting the respective assigned yarn portion into a substrate that is situated below the tufting unit.

The tufting unit according to the invention has proven particularly reliable and unsusceptible to defects in operation. One reason therefore can be seen in that, for example, the yarn infeed installation ensures simultaneous and parallel infeeding of the yarn strands which can then be directly acquired by the yarn transport gripper. Said yarn transport gripper in turn in a simple manner ensures that the yarn strands, or yarn portions, respectively, can make their way to a position in which said yarn strands or yarn portions, respectively, can be directly inserted into the substrate by the insertion element.

All described and/or necessary procedures can be carried out in a fully automated manner. It is possible herein to resort to simple control mechanisms, for example those that are disclosed further below.

It is to be understood that a tufting unit can be that part of the tufting machine, for example, which is specifically specified for providing and inserting yarn portions. This can correspond to the functionality described herein, for example. A tufting machine typically includes such a tufting unit and has further components such as, for example, a running gear, a drive, a coupling, a control system, or other supporting systems. Furthermore, a tufting machine typically also has means for stocking yarns which can then be used by means of the tufting unit.

Parallel infeeding can be understood to mean, for example, that the yarn strands run in a mutually parallel manner. Simultaneous infeeding can in particular be understood to mean that the yarn strands, in particular yarn strands lying in parallel, are moved in an identical manner. This has proven to be particularly advantageous in particular when a particularly large number of yarn strands are to be processed simultaneously in order to shorten the necessary processing time.

An insertion element can in particular be understood to be that element that ensures that yarn portions are incorporated into the substrate. This herein can be, for example, a tufting needle as will be described in more detail further below. It can in particular be provided that an identical number of insertion elements and yarn strands are used such that a respective insertion element is assigned to each yarn strand, said insertion element inserting yarn portions of the respective yarn strand into the substrate.

A yarn strand which is assigned to a respective insertion element can be disposed below said insertion element, for example. This permits a simple insertion into the substrate. Hereinbelow it is to be understood in particular that a lowest point of the respective yarn strand is arranged directly below the insertion element. Further parts of the yarn strand can in particular stand upwards, for example in the form of a V.

According to one preferred embodiment, the yarn infeed installation has a plurality of rotating yarn holders. A respective yarn holder herein can typically hold and release the yarn strands. A particularly simple operation can be guaranteed on account of a rotating assembly since a rotation about one axis is sufficient for the advancing action.

The yarn holders herein can be configured so as to in each case interact in pairs, for example, such that each yarn strand prior to cutting is held by two yarn holders of one pair. On account thereof, a specific portion in the yarn strands which lies between two yarn holders that in each case interact in pairs can be defined. For example, the yarn strands can be cut between the yarn holders of a respective pair.

According to one potential embodiment, the yarn infeed installation has three pairs of yarn holders. According to one further potential embodiment, the yarn infeed installation has four pairs of yarn holders. Embodiments of this type have proven advantageous since a number of three of four pairs of yarn holders guarantees an ongoing operation and is easy to handle. In principle however, any other number of pairs of yarn holders can also be used. It is likewise mentioned that the yarn holders do not necessarily have to be combined in pairs.

According to one preferred embodiment, the yarn transport gripper for gripping the free ends of the yarn strands is configured for gripping respective end portions of the yarn strands which are clamped between two yarn holders of one pair. On account of being gripped at the end portion, the respective yarn strand can be gripped at a portion at which it is advantageously held. This prevents errors during gripping. For example, the respective yarn strand can also be pulled onward by means of the yarn transport gripper, wherein unwinding from a package can also be provided, for example.

The yarn infeed installation before each tufting procedure can preferably be configured for rotating and/or guiding the yarn holders onward. For example, new end portions of the yarn strands can be provided herein for gripping by the yarn transport grippers. An advancing action of the respective yarn strands is performed in a simple manner by the onward rotating or onward guiding.

The yarn holders are preferably disposed so as to be rotatable about a respective common axis. This permits particularly simple rotating of the yarn holders.

According to one preferred embodiment, each yarn holder has a first yarn holder plate and a second yarn holder plate which for holding and releasing the yarn strands are mutually displaceable. For example, yarns can be clamped between these two yarn holder plates. Yarn holders can also conjointly use yarn holder plates, for example yarn holders of one pair of yarn holders.

According to one preferred embodiment, each yarn holder has at least one upper, one central, and one lower yarn holder plate. The central yarn holder plate herein for holding and releasing the yarn strands is preferably displaceable in relation to the two other yarn holder plates by a drive, in particular a hydraulic drive. For example, yarn strands can thus be clamped between the central and the upper yarn holder plate as well as between the central and the lower yarn holder plate. Said yarn strands can be released again in a corresponding manner by way of a displacement.

According to one preferred embodiment, each yarn holder has at least one first, one second, one third, and one fourth yarn holder plate. The second and the fourth yarn holder plates for holding and releasing the yarn strands herein are preferably displaceable in relation to the two other yarn holder plates by a drive, in particular a hydraulic drive. This enables clamping between two pairs of plates which enables particularly reliable clamping of the yarn strands.

At least one yarn holder plate by means of a closing cam and an opening cam which are in each case preferably movable by one drive, in particular by one hydraulic drive, is preferably displaced relative to the other yarn holder plate. By means of respective opening cams and closing cams it can be achieved that a respective yarn holder plate revolving in a rotating manner is displaced solely on account of a movement along a path, for example along a circular path, and on account thereof clamps or releases yarn strands at predefined locations. This does not require any further active elements so that clamping or releasing, respectively, takes place automatically. Additionally, a movement of the closing cam and/or the opening cam can be enabled on account of a drive, in particular on account of a hydraulic drive, this permitting an activation independently of a movement along the path, for example. It can thus be achieved, for example, that yarn strands are released at specific point in time without the yarn holder plate having to be moved onward to this end.

The yarn infeed installation is preferably configured for releasing the yarn strands during transportation. This can take place, for example, on account of a corresponding design embodiment of opening cams and/or closing cams, or else by an activation by means of a drive.

The yarn transport gripper during transportation preferably pulls the yarn strands through the yarn infeed installation. A corresponding advancing action by means of the yarn transport gripper can be achieved on account thereof. It can also be provided that the yarn transport gripper during transportation unwinds the yarn strands from the respective yarn packages. Further infeeding of yarn from the yarn packages provided therefor by means of the yarn transport gripper can in each case be achieved on account thereof. Further elements for unwinding, or for a respective advancing action, respectively, can preferably be dispensed with herein. It is to be understood, however, that an active unwinding of yarn packages can also alternatively or additionally be provided.

According to one preferred embodiment, the tufting unit has an entry-side deflection for guiding the yarn strands ahead of the yarn infeed installation. A reliable provision of the yarn strands ahead of the yarn infeed device can be achieved on account thereof.

According to one preferred embodiment, the cutting unit has a cutting blade and a counter blade which for cutting off the yarn portions are mutually displaceable. On account thereof, the cutting unit can be implemented in a simple manner, wherein a high scalability is in particular possible, that is to say that very many yarn strands can be simultaneously cut using only one cutting blade and only one counter blade. Alternatively, however, separate cutting tools for the respective yarn strands can also be present.

The cutting blade is preferably displaceable relative to the counter blade by means of a drive, in particular a hydraulic cylinder. An activation of the cutting blade can thus be implemented in a simple manner. However, other possibilities for activating the cutting blade are also possible.

According to one preferred embodiment, each insertion element has one tufting needle which is configured for gripping the respective yarn portion and inserting the latter into the substrate. A simple insertion of the respective yarn portion is possible by means of such a tufting needle, wherein the tufting needle is typically vertically disposed and moves only in a one-dimensional manner, in particular in the vertical direction. This enables a very simple embodiment. The tufting needle can penetrate the substrate to the extent as required, and can then be retracted again. A setting capability of the desired depth can also be implemented in a simple manner herein.

The respective tufting needle herein is preferably movable vertically and/or perpendicularly to the substrate. This enables a simple insertion movement. The directional indication herein can refer in particular to a typical installed state in a tufting machine that travels on a surface. It can in particular be provided that all tufting needles of the tufting unit are movable in a conjoint or uniform, respectively, manner.

The tufting unit on the lower side preferably has a tufting plate in which at least one opening for guiding the yarn portion is configured. It can be ensured by means of such an opening that the yarn portion during insertion remains in position and is optionally also bent. Guiding of the respective tufting needle, or of the insertion element, respectively, can moreover be achieved.

The tufting unit preferably has at least one needle guide for guiding the tufting needles, or for guiding a respective tufting needle, wherein, according to a preferred embodiment, each needle guide with the tufting needles is partially movable, preferably so as to stop short of the substrate or so as to stop short of the tufting plate. The tufting needles by means of such a needle guide can be stabilized and guided in preferred manner such that malfunctions and downtimes associated therewith can be effectively prevented. The needle guide can be embodied such, for example, that each tufting needle is enclosed, for example by way of only a minor clearance, such that any movement of the respective tufting needle transversely to the respective longitudinal direction is prevented.

According to one embodiment, the insertion element during the movement can unwind the yarn strands from the respective yarn packages. An unwinding function when inserting, or during another movement, can be implemented on account thereof, for example. To this end, the respective yarn strands can be held by the yarn transport gripper, for example, wherein the unwinding takes place on account of the movement of the respective insertion element.

For example, portion halves of identical length can be generated on account of the movement of the insertion elements, or of the tufting needles, respectively. Such a functionality can be advantageously also used for unwinding, for example.

The yarn transport gripper can be mounted so as to be pivotable on a pivot point, for example. A simple activation of the yarn transport gripper can be enabled on account thereof. For example, the activation can take place by means of a movable element which grips on a point which is different from the pivot point. The yarn transport gripper can thus be pivoted and thus carry out only a one-dimensional movement which is easy to implement. For example, the functionality of transporting yarn strands or else of unwinding the yarn strands from packages can be implemented in the case of such a pivoting movement.

The tufting unit can have an activatable bar for pivoting the yarn transport grippers, for example. The bar can be activatable hydraulically, or by a crank mechanism, for example. The pivoting movement of the transport gripper already mentioned can be advantageously implemented by means of said bar and/or of the associated drive.

The yarn transport gripper can in particular have a transport gripper for gripping the free ends of the yarn strands. The transport gripper can in particular be configured for firmly holding and releasing the yarn strands, or the free ends thereof, respectively, so as to implement the desired function. For example, a respective yarn strand can be firmly held for transportation, wherein said yarn strand can be released for inserting, for example.

The transport gripper can have a first transport gripper plate and a second transport gripper plate, for example, which for gripping and releasing the free ends are mutually displaceable, in particular by a hydraulic drive. Simple clamping or releasing, respectively, of the yarn strands can be implemented on account thereof.

The yarn transport gripper can in particular be configured for releasing the yarn portions during inserting. This enables a free movement of the yarn portions while the latter are being inserted.

According to one preferred embodiment, the cutting unit can be pivotably mounted. This enables said cutting unit be moved to a corresponding position when this is required. In terms of the implementation and the advantages of pivoting, reference is to be made to the above explanations pertaining to the yarn transport gripper.

For example, the cutting unit prior to a respective cutting procedure can be configured for being pivoted toward the yarn strands, and after the cutting procedure can be configured for being pivoted away from the yarn strands. It can be achieved on account thereof that the yarn strands can move, or be pulled onward, respectively, independently of the cutting unit, while the cutting unit is in the corresponding position only when a cutting procedure is actually to be carried out.

The tufting unit preferably has a setting device for the terminal position of the yarn transport gripper and/or the position of the cutting installation. On account thereof it can be established, for example, how far the respective yarn strands are pulled through the yarn transport gripper. It can also be established in which position the cutting installation is to cut the yarn strands. This permits different application purposes, for example different insertion depth or different yarns, to be adapted to, for example. The respective setting device can be implemented mechanically, for example. It can be activatable manually or else electrically, for example.

The tufting unit preferably has a depth setting device for the penetration depth of the tufting needle into the substrate. It can thus be set in a simple manner how far the tufting needles when inserting are to be moved downward, and it can thus also be established how far respective yarn strands are to be incorporated into the substrate. This enables different requirements in terms of the depth at which the yarn portions are ultimately also to remain in the substrate to be adapted to. Depending on how the yarn strands are cut off, it can thus also be set how far the yarn portions project from the substrate after the respective insertion procedure has been completed. The depth setting device can be implemented as a mechanical height adjuster, for example. It can be activatable manually or electrically, for example.

The invention furthermore relates to a tufting machine for inserting into a substrate that is situated below the tufting unit in each case one yarn portion from a yarn strand that is in each case positioned and cut off by a tufting unit according to the invention. The tufting machine has in particular a tufting unit, wherein this can in particular be a tufting unit according to the invention. Herein, all embodiments and variants described herein can be resorted to.

The tufting machine, in addition to the tufting unit, can in particular have further components such as, for example, a frame, a running gear, a drive, a coupling for hitching to a towing vehicle, a control system, an operator unit, yarn rolls for storing and unwinding yarn strands, as well as other components.

It can be provided that the yarn transport grippers, preferably in an alternating pivoting movement, transport in each case the end portions of the yarn that are kept ready by the yarn infeed installation away from the yarn infeed installation. It can furthermore be provided herein that the yarn transport grippers assign and respectively position the respective yarn strand to in each case one insertion element. Once the cutting unit has cut off the respective yarn portions from the respective yarn strands, the insert element can insert the respective yarn portions into the substrate.

BRIEF DESCRIPTION OF THE DRAWINGS

The invention is schematically illustrated in particular in exemplary embodiments in the drawing in which.

DETAILED DESCRIPTION

Identical or mutually equivalent elements are in each case identified with the same reference sign in the figures and are therefore not described yet again, unless this is expedient. The disclosures contained in the entire description can be applied in analogous manner to identical parts having the same reference signs, or the same component reference signs, respectively. Also, the positional indications chosen in the description such as, for example, top, bottom, lateral, etc., relate to the figure directly described and illustrated, and in the case of a positional modification are to be transferred in analogous manner to the new position. Furthermore, individual features or combinations of features of the different exemplary embodiments shown and described can also per se represent independent inventive solutions, or solutions according to the invention.

Figure 1:
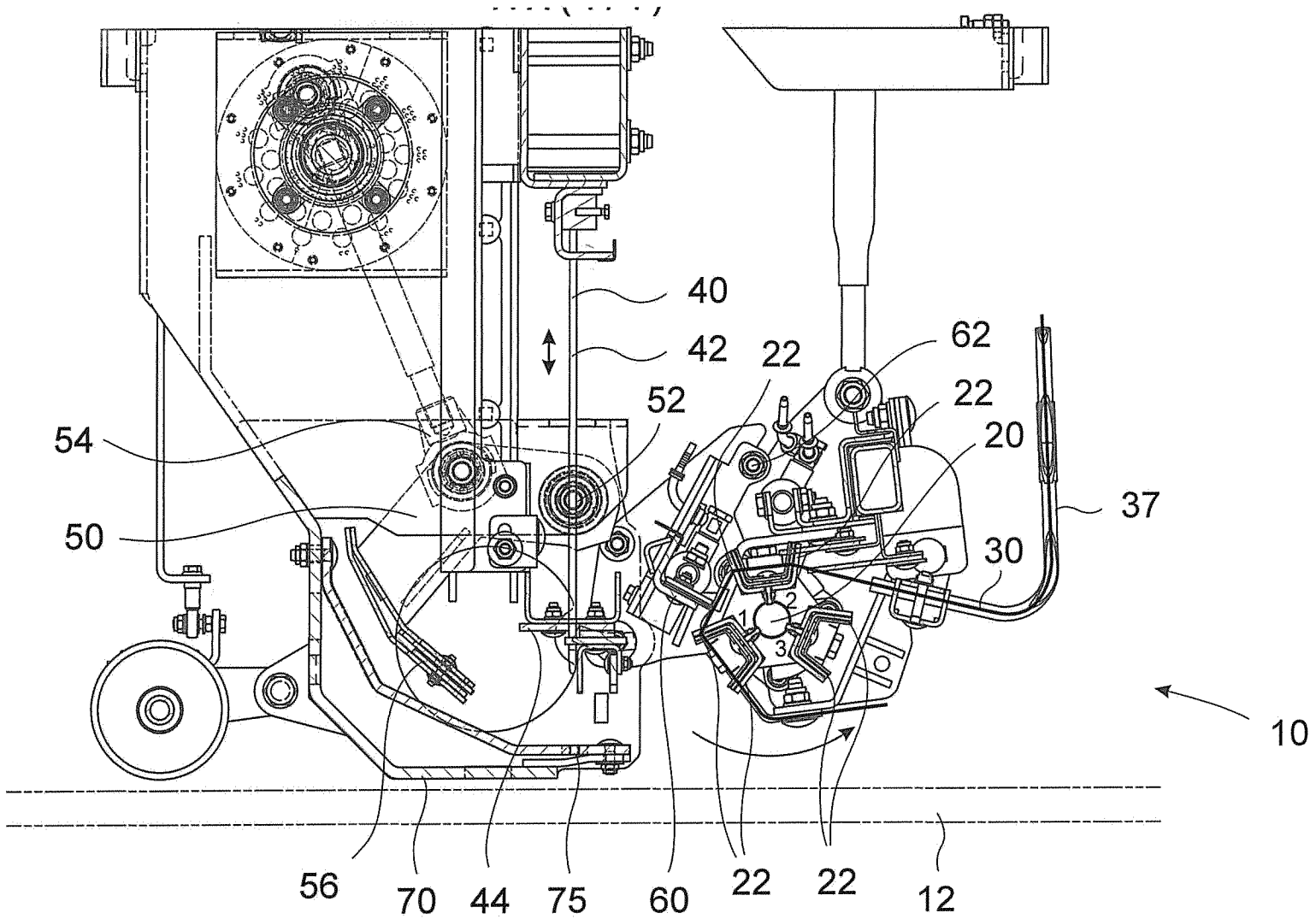
FIG. 1 shows a tufting unit in a first state.

FIG. 1 shows a tufting unit 10 according to one exemplary embodiment of the invention. The tufting unit 10 herein is illustrated in a first state in FIG. 1. The tufting unit 10 is also illustrated in FIGS. 2 to 5, wherein the figures show in each case different states. Overall, a typical method sequence for using the tufting unit 10 which commences with providing corresponding yarn strands and ends with the insertion of yarn portions into a substrate 12 is illustrated in FIGS. 1 to 5. It is to be understood that the method sequence illustrated can also be considered an independent aspect of the invention.

The tufting unit 10 has a yarn infeed installation 20. The yarn infeed installation has a total of six yarn holders 22 which are grouped so as to form three pairs of in each case two yarn holders 22. Two yarn holders 22 of one pair herein are in each case disposed in an approximately U-shaped configuration. The pairs are identified by the reference signs 1, 2, 3.

The yarn infeed installation 20 is configured such that said yarn infeed installation 20 can rotate about a centric axis. A drive which can be embodied so as to be electrical or mechanical which is not illustrated, for example, serves to this end. In the case of such a rotation of the yarn infeed installation 20, the yarn holders 22 are conjointly rotated in a corresponding manner.

The tufting unit 10 is fed a plurality of yarn strands 30. Said yarn strands 30 are not part of the tufting unit 10 but are used, that is to say cut and used, by the tufting unit 10. A deflection 37 which ensures that the yarn strands 30 are fed along a predefined curve serves in particular herein for feeding the yarn strands 30.

The yarn strands 30 herein run in a mutually parallel manner, wherein only one yarn strand 30 can in each case be seen in the view of FIG. 1 and also further figures. The further yarn strands 30 herein run parallel to the visible yarn strand 30, behind the paper plane.

The yarn holders 22 are in each case configured for either gripping or releasing the yarn strands 30. When the yarn strands 30 are gripped by the respective yarn holder 22, this means that the yarn strands 30 are entrained on account of a movement of the respective yarn holder 22, in particular in the context of the already described rotation of the yarn infeed installation 20. On account thereof, additional yarn can be fed, for example, wherein said yarn can be unwound from respective packages (not shown), for example.

The tufting unit 10 has in the present case a plurality of insertion elements 40. A respective insertion element 40 herein is configured as a tufting needle 42. As shown, the tufting needle 42 is vertically aligned. Said tufting needle 42 can be moved in the vertical direction, thus in a one-dimensional manner, this corresponding to an up-and-down movement.

The tufting unit 10 has exactly as many tufting needles 42 as said tufting unit 10 processes yarn strands 30. One respective tufting needle 42 is thus assigned to each yarn strand 30. Each tufting needle 42 herein fundamentally serves for inserting a respective yarn portion into the substrate 12 below the tufting unit 10. The exact functional mode is yet to be discussed in more detail further below.

The tufting unit 10 furthermore has a needle guide 44 which is disposed such that the tufting needles 42 extend through the needle guide 44. The tufting needles 42 are stabilized by the needle guide 44. This means in particular that said tufting needles 42 can move substantially only in a manner corresponding to the envisaged up-and-down movement. Any temporary departure therefrom and malfunctions potentially associated therewith are reliably prevented on account thereof.

The tufting unit 10 has a yarn transport gripper 50. The yarn transport gripper 50 is mounted so as to be pivotable about a pivot point 52. In order for the yarn transport gripper 50 be activated, the tufting unit 10 has an activatable bar 54 which presently is embodied so as to be hydraulically activatable. The activatable bar 54 is connected to the yarn transport gripper 50 at a location which is different from the pivot point 52. On account thereof, a pivoting movement of the yarn transport gripper 50 can be induced by means of the activatable bar 54.

The yarn transport gripper 50 has a transport gripper 56. The transport gripper 56 is configured for firmly clamping or else releasing the yarn strands 30. When the yarn transport gripper 56 firmly clamps the yarn strands 30, said yarn strands 30 can be transported in particular by means of the pivoting movement just described, and also be pulled onward, for example. Unwinding of the yarn strands 30 from respective packages can also be induced on account thereof, for example. The exact functionality is to be discussed in more detail further below.

Figure 3:
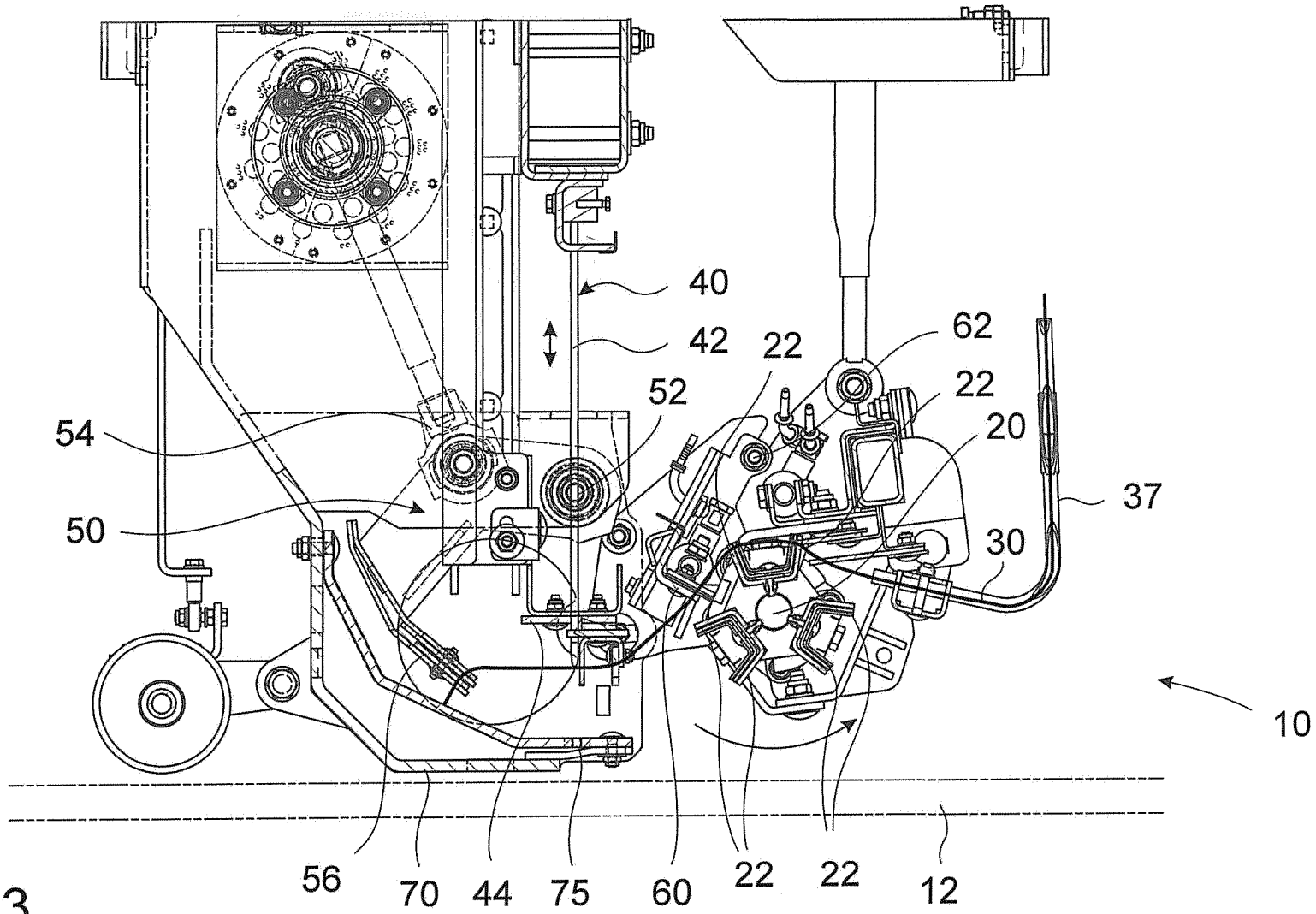
FIG. 3 shows the tufting unit in a third state.

The tufting unit 10 has a cutting unit 60. As shown, the cutting unit 60 is likewise configured so as to be pivotable, specifically about a pivot axis 62. The cutting unit 60 is configured for cutting off the yarn strands 30. This can take place in particular in a state which is illustrated in FIG. 3. The yarn strands 30 herein run through the cutting unit 60, as is shown, which is why the cutting unit 60 can cut off said yarn strands 30 in a simple manner. This is to be discussed in more detail further below. The cutting unit 60 can then be pivoted for further method steps such that the yarn strands 30 can be transported independently of the cutting unit 60, or can assume corresponding positions in space independently of the latter, respectively.

The tufting unit 10 below the needle guide 44 has a tufting plate 70. Respective openings 75 are configured in said tufting plate 70. Each tufting needle 42 herein is assigned one respective opening 75, wherein the respective tufting needle 42 runs through the respective opening 75 when the respective tufting needle 42 is displaced downward. This is to be discussed in more detail further below.

The tufting needles 42 can be stabilized just before being introduced into the substrate 12 by means of the tufting plate 70. Any lateral deviation or other malfunctions are reliably prevented on account thereof.

Figure 2:
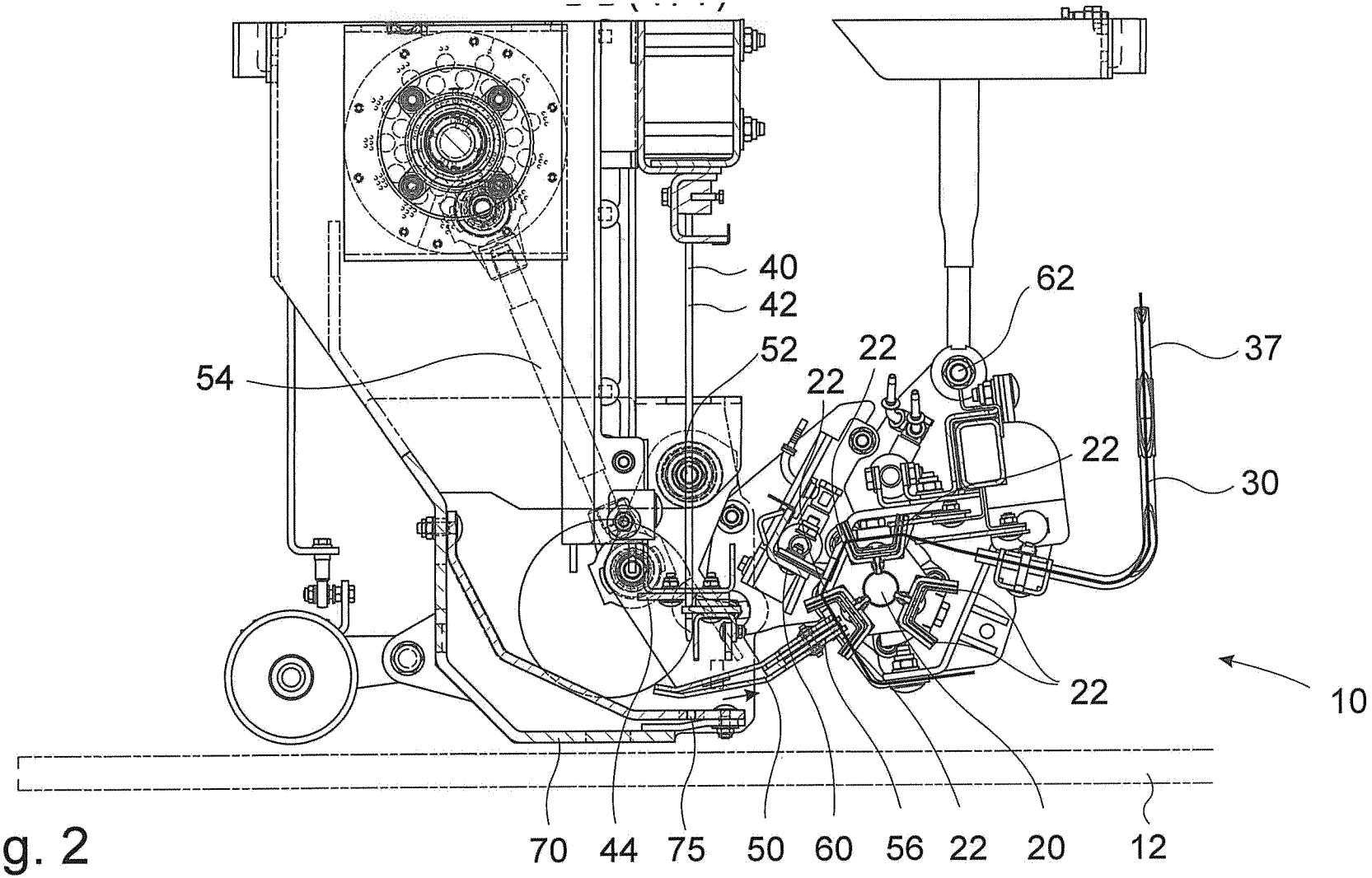
FIG. 2 shows the tufting unit in a second state.

FIG. 2 shows the tufting unit 10 in a state in which, proceeding from the state illustrated in FIG. 1, method steps have been carried out.

The yarn transport gripper 50 herein has in particular been pivoted to the right, this having taken place by deploying the activatable bar 54. The transport gripper 56 now comes to engage with the yarn strands 30 on account of this pivoting movement, specifically at a location between two yarn holders 22 that are assigned in pairs. The transport gripper 56 can then grip the yarn strands 30, which can in particular take place by displacing a first transport gripper plate in relation to a second transport gripper plate, wherein the yarn strands 30 can typically be clamped between the two transport gripper plates. However, more than two transport gripper plates can also be used, for example, said more than two transport gripper plates being able to be at least partially displaced in relation to one another.

It is to be understood that the pivot point 52 in the figures appears to lie only coincidentally above the tufting needles 42. There is no mechanical connection here.

FIG. 3 shows the tufting machine 10 in a further state after a further method step, which lies in particular in pivoting the yarn transport gripper 50 to the left. The yarn strands 30 herein, as has already been mentioned, have previously been gripped by means of the transport gripper 56. The yarn strands 30 herein are released by the yarn holders 22 such that the yarn transport gripper 50 can pull the yarn strands 30 so as to follow from packages (not illustrated). The yarn strands 30 are now at least partially situated below the needle guide 44. One yarn strand 30 herein is now assigned to one tufting needle 42 in such a manner that a yarn strand 30 situated below the respective tufting needle 42. On the left side, the yarn strands 30 are now held by the yarn transport gripper 50. On the right side, said yarn strands 30 are held by the yarn infeed installation 20.

In order for the state which is illustrated in FIG. 3 to be reached, the yarn strands 30 by way of a pivoting movement have been pulled though by the yarn transport gripper 50 below the respectively assigned tufting needle 42 such that the yarn strands 30 are now held by the transport gripper 56 and bear on the needle guide 44 directly below a respectively assigned tufting needle 42.

Figure 4:
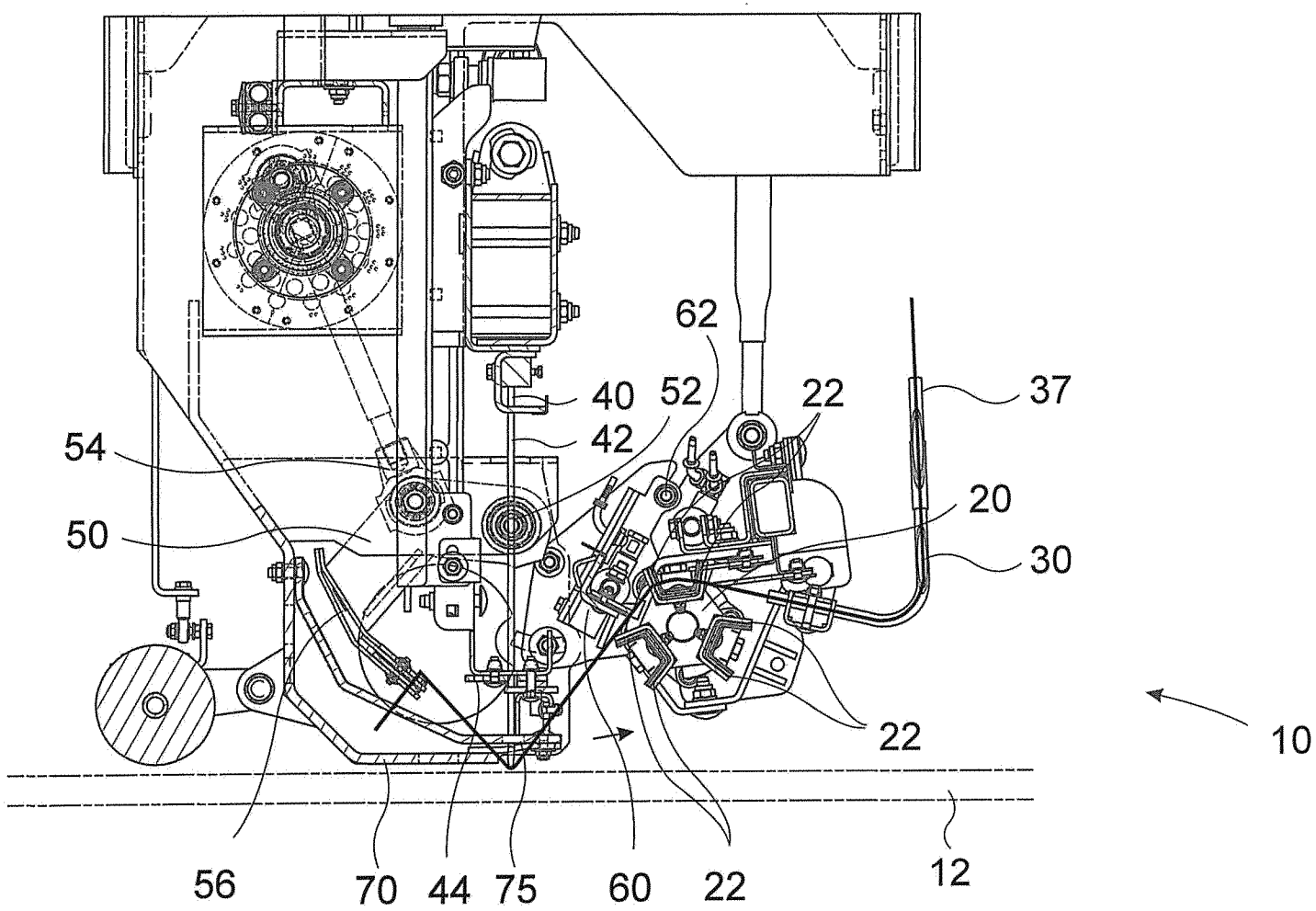
FIG. 4 shows the tufting unit in a fourth state.

FIG. 4 shows the tufting unit 10 in yet a further state. The tufting needles 42 herein have been repositioned downward, and the needle guide 44 has been displaced downward conjointly with said tufting needles 42. The needle guide 44 is now directly adjacent to the tufting plate 70. As is shown, the respective tufting needle 42 projects downward beyond the needle guide 44 such that the yarn strand 30 that lies in each case below said needle guide 44 is gripped and pushed downward. This leads to the tip of the yarn strand 30 which in FIG. 4 can be seen directly below the tufting needle 42. The yarn strands 30 herein are pulled onward so as to follow somewhat. The yarn strands 30 are subsequently cut by the cutting unit 60 so that a transition can take place to the state illustrated in FIG. 5.

The tufting needles 42 herein have been moved downward so far that said tufting needles 42 invade the substrate 12. On the right side, those regions of the yarn strands 30 that pass below the tufting needles 42 herein have been cut by the cutting unit 60. On the left side, the respective free ends have been released by the transport gripper 56. Each tufting needle 42 is thus assigned one respective yarn portion 35 which is no longer connected to the remainder of the respective yarn strand 30.

The respective yarn portion 35 by way of the downward-directed movement of the respective tufting needle 42 is entrained downward into the substrate 12. Said respective yarn portion 35 herein is inserted in such a manner that one part of the yarn portion 35 is situated in the substrate 12 but one part of said yarn portion 35 projects upward. The respective yarn portion 35 is thus anchored in the substrate 12, on the one hand, but also has portions that project upward, on the other hand. The latter can project beyond the substrate 12 by 20 mm, for example, wherein it is mentioned that other values are also possible. This corresponds to a typical embodiment of an artificial turf, wherein the upward-protruding portions form the visible and receivable part of the artificial turf.

Figure 5:
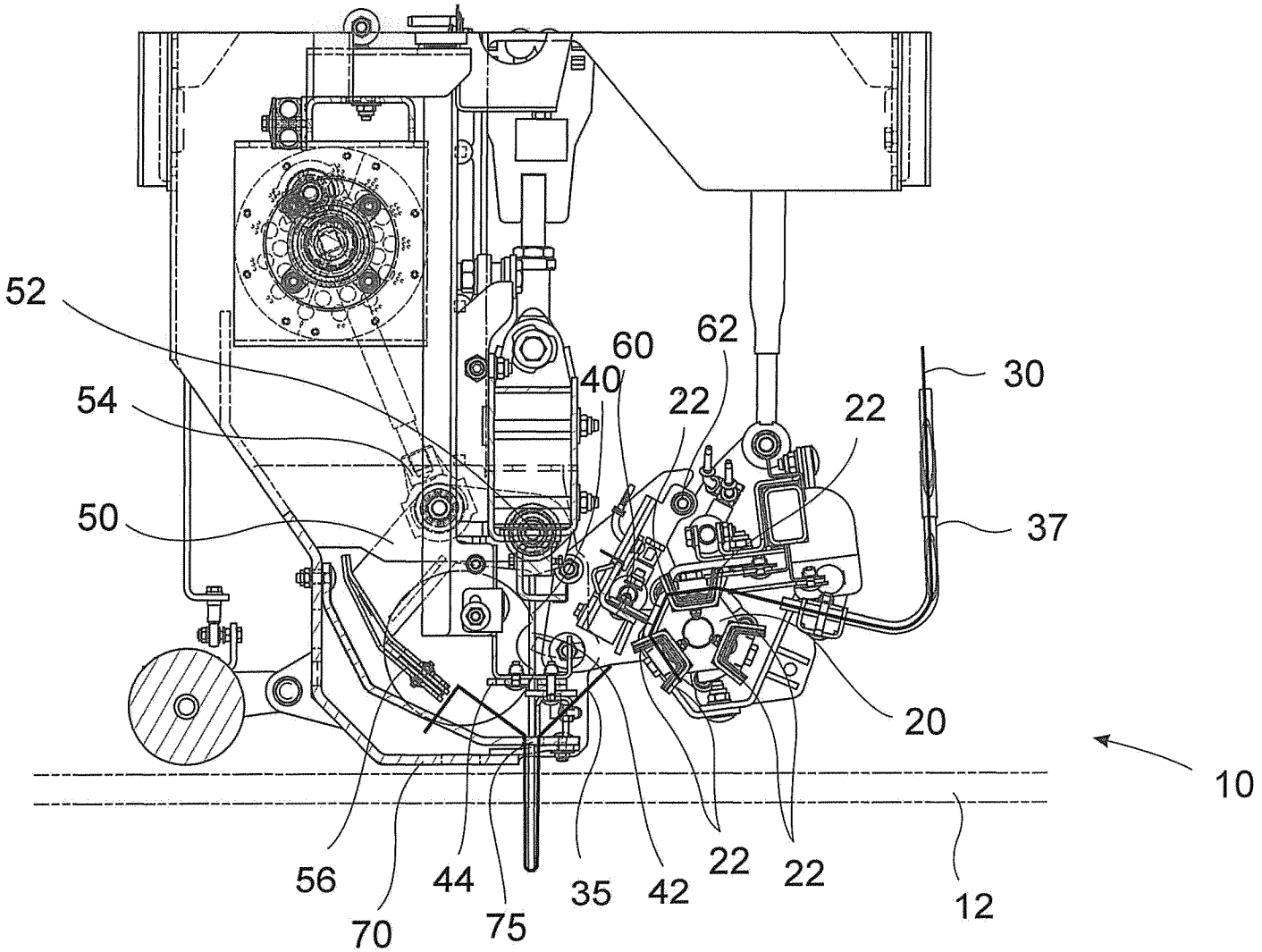
FIG. 5 shows the tufting unit in a fifth state.

In the transition from the state illustrated in FIG. 4 to the state illustrated in FIG. 5 the yarn infeed installation 20 has furthermore been rotated onward by 120° to the left. On account thereof, yarn strands 30 are now again situated between yarn holders 22 such that the yarn transport gripper 56 can grip said yarn strands 30 and pull them to the left, as has already been described further above. The method sequence described herein can then recommence.

Figure 6:
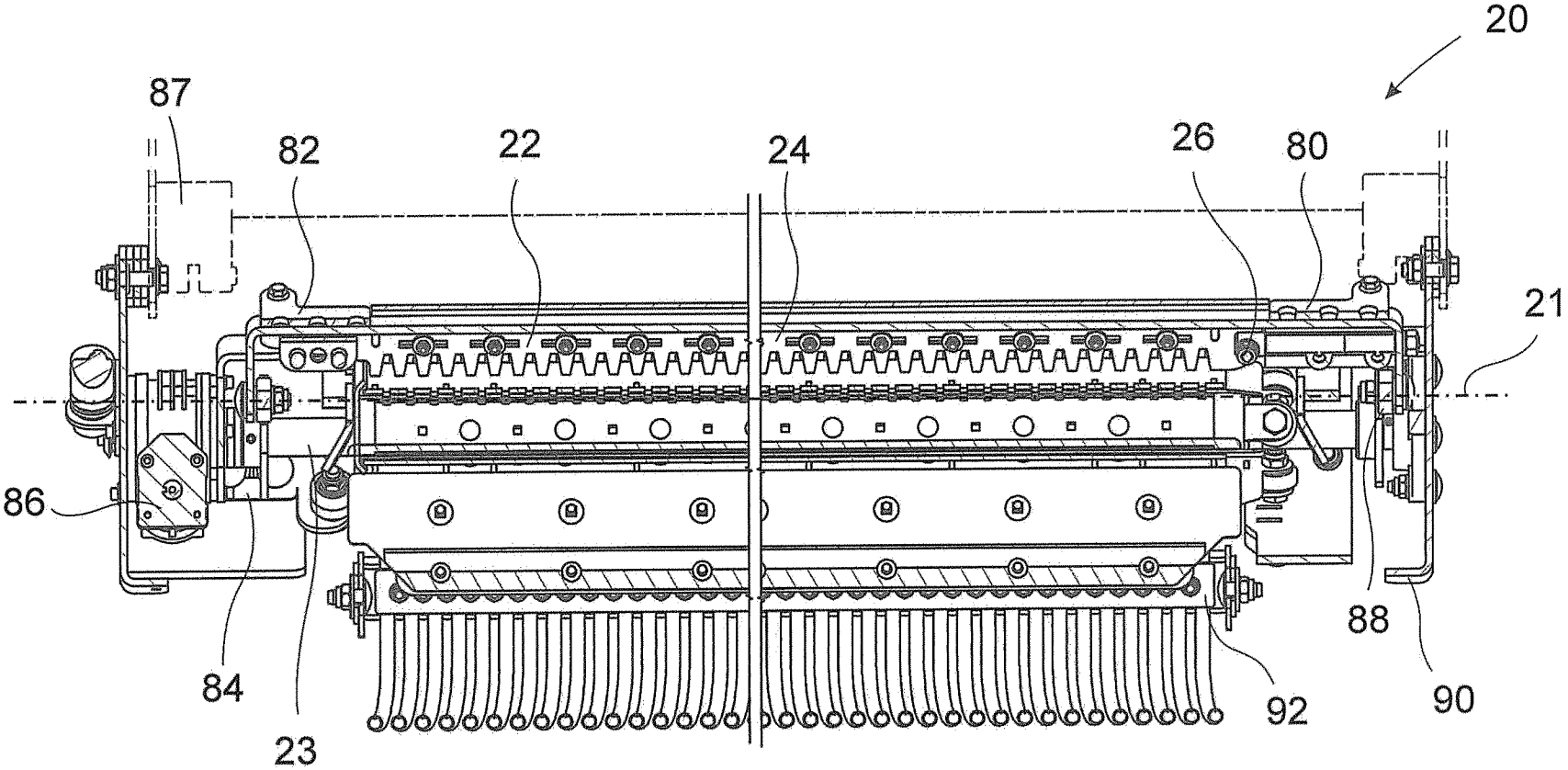
FIG. 6 shows one part of a yarn infeed installation.

FIG. 6 shows one part of the yarn infeed installation 20.

The yarn infeed installation 20 is rotatable about an axis 21. The yarn infeed installation 20 has a shaft 23 to which the yarn holders 22 already described are fastened. As has already been mentioned with reference to FIG. 1, the yarn holders 22 are herein in the present case arranged in pairs, namely in three pairs in the present case. The yarn holders 22 are connected to rotate with the shaft 23.

A motor 84 serves for driving the shaft 23. Said motor 84 simultaneously also serves as the left-side mounting of the shaft 23. On the right side, the shaft 23 is mounted in a ball bearing 88.

An impulse generator wheel 86 and a sensor 87 disposed thereon are situated to the left of the motor 84. The rotation of the shaft 23 can thus be monitored.

One part of a yarn holder 22 is schematically illustrated directly above the shaft 23 in FIG. 6. Said part has a movable yarn holder plate 24 which is mounted such that said yarn holder plate 24 is displaceable exclusively in a one-dimensional manner so as to be delimited in the horizontal direction. The yarn holder 22 furthermore has a guide wheel 26 which is rigidly connected to the movable yarn holder plate 24. A movement of the guide wheel 26 is thus transmitted directly to the movable yarn holder plate 24.

An opening cam 80 and a closing cam 82 serve for establishing the movement of the movable yarn holder plate 24. Said opening cam 80 and said closing cam 82 are in each case configured as solid elements.

The guide wheel 26 in the state illustrated in FIG. 6 bears directly on the opening cam 80. On account thereof, the moveable yarn holder plate 24 is controlled in terms of the horizontal movement thereof, wherein the guide wheel 26, in a manner corresponding to the already described revolution of the yarn holder 22, moves about the axis 21 along the opening cam 80. A horizontal movement of the guide wheel 26 and thus also a corresponding horizontal movement of the movable yarn holder plate 24 can thus be achieved on account of the design of the surface of the opening cam 80 that faces the guide wheel 26.

As will yet be described in more detail further below, the yarn holder 22 also has at least one stationary yarn holder plate, wherein the movable yarn holder plate 24 is in particular movable relative to said stationary yarn holder plate. Yarn strands can be clamped between the two plates on account of the design of the two plates. Yarn strands can in particular be clamped when the movable yarn holder plate 24 is situated in a state following a horizontal displacement to the right. By contrast, when the movable yarn holder plate 24 is displaced to the left, for example by way of the opening cam 80, as has just been described, the yarn strands are thus released such that said yarn strands can move freely along the respective longitudinal direction of said yarn strands.

The yarn infeed installation 20 furthermore has a drive 90 which serves for moving the opening cam 80 and the closing cam 82 in the horizontal direction. On account thereof, opening or closing can be effected independently of the movement of the respective yarn holder 22 along the circular path. This will be described in more detail hereunder with reference to FIG. 7.

Figure 7:
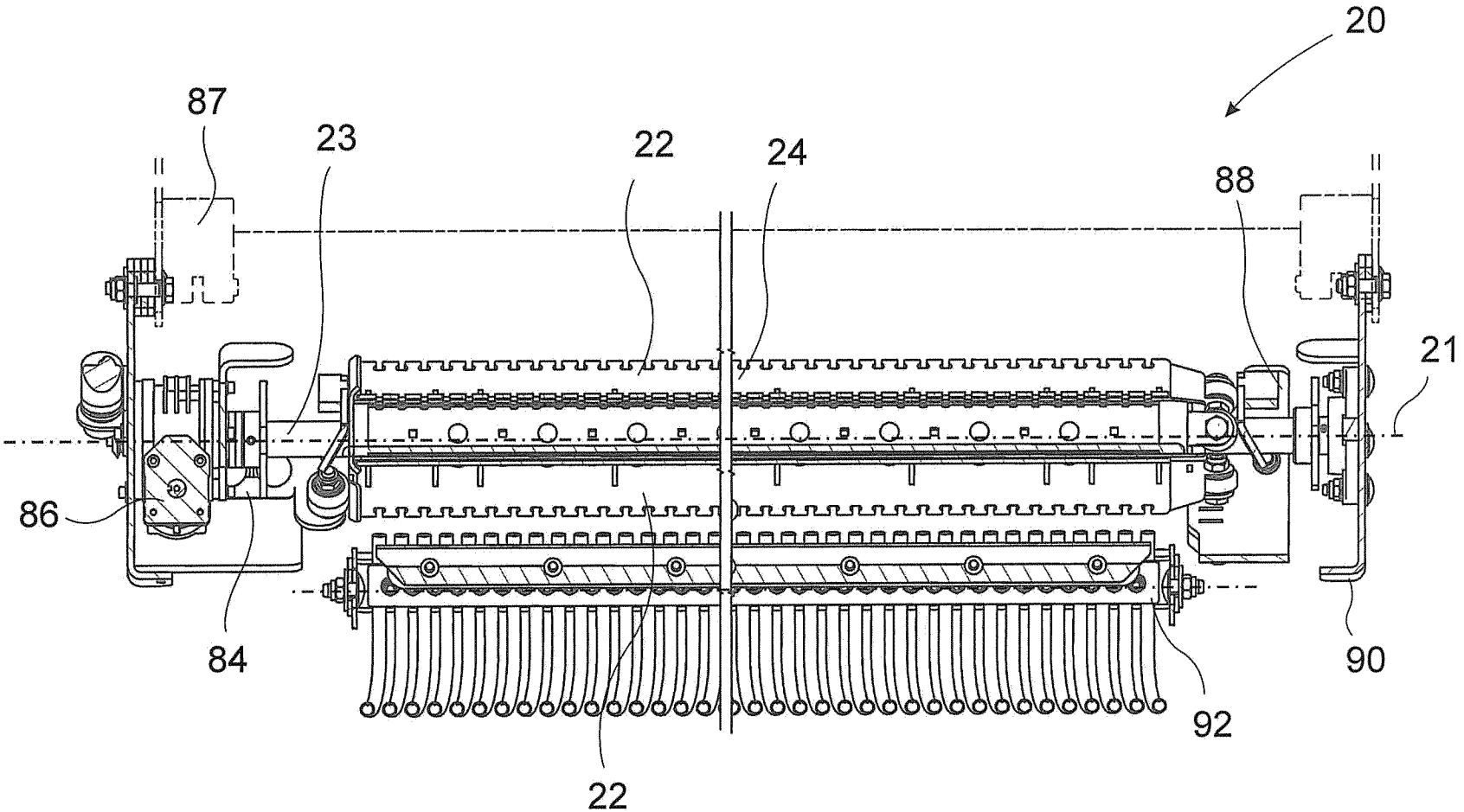
FIG. 7 shows another part of a yarn infeed installation.

FIG. 7 shows the yarn transport installation 20 from another view and in another state. In terms of the components already described, reference is to be made to the description of FIG. 6.

The drive 90 is connected to one or more guide bars of which one guide bar 92 is visible in FIG. 7. The guide bars 92 herein are rigidly connected to the opening cam 80 and to the closing cam 82, wherein the opening cam 80 and the closing cam 82 are mounted such that they are movable in a delimited horizontal manner. The opening cam 80 and the closing cam 82 can thus also be moved in the same manner by way of a movement of the guide bars 92.

Horizontal movement of the opening cam 80 and of the closing cam 82 is thus possible by means of the drive 90 which can move the guide bars 92. This permits, for example, releasing yarn strands independently of a movement of the respective yarn holder along the provided circular path.

It is to be understood that the closing cam 82 acts on the movable yarn holder plate 24 in a manner similar as has been described with reference to the opening cam 80, but in particular in the opposite direction. A displacement of the movable yarn holder plate 24 to the right can in particular be effected by means of the closing cam 82 such that a clamping of yarn strands can be effected, for example.

Figure 8:
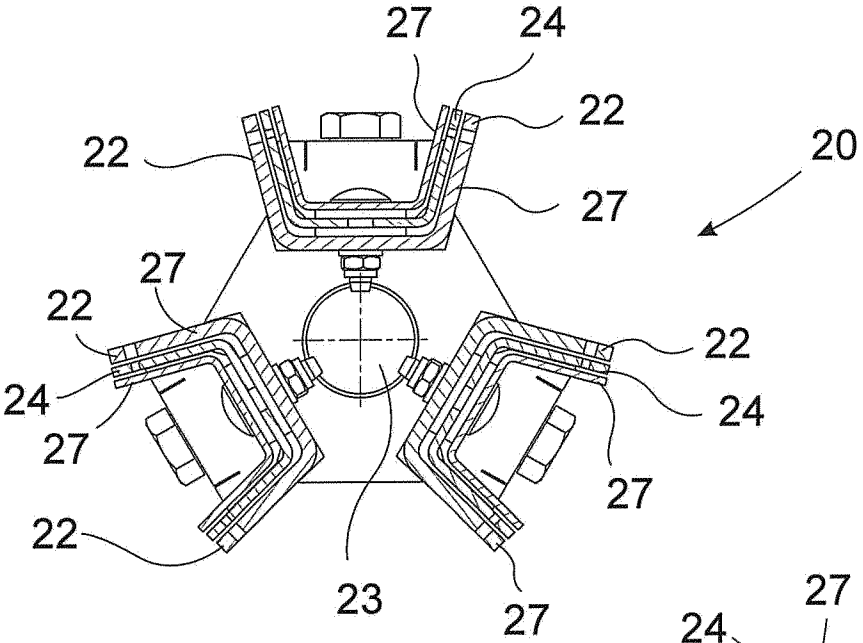
FIG. 8 shows yarn holder of a yarn infeed installation according to a first embodiment.

FIG. 8 shows the yarn transport installation 20 in a sectional view, seen from a direction transverse to that of FIGS. 6 and 7. The respective pair-wise combination of in each case two yarn holders 22 in a respective U-shape can be clearly seen herein. Furthermore, it can be seen how the latter are internally constructed.

Two stationary yarn holder plates 27 which are not displaceable and are fixedly connected to the shaft 23 are in each case installed on the external side herein.

The movable yarn holder plate 24 is disposed so as to be centric between the two stationary yarn holder plates 27. Said movable yarn holder plate 24 is embodied so as to be horizontally displaceable, as has already been mentioned. On account of the design embodiment of the yarn holder plates 24, 27 (not visible in FIG. 8) as already described, yarn strands 30 can be clamped or else released between said two yarn holder plates 24, 27. By clamping it becomes in particular possible for the corresponding yarn strands 30 to be entrained by way of a rotation of the yarn infeed installation 20.

Figure 9:
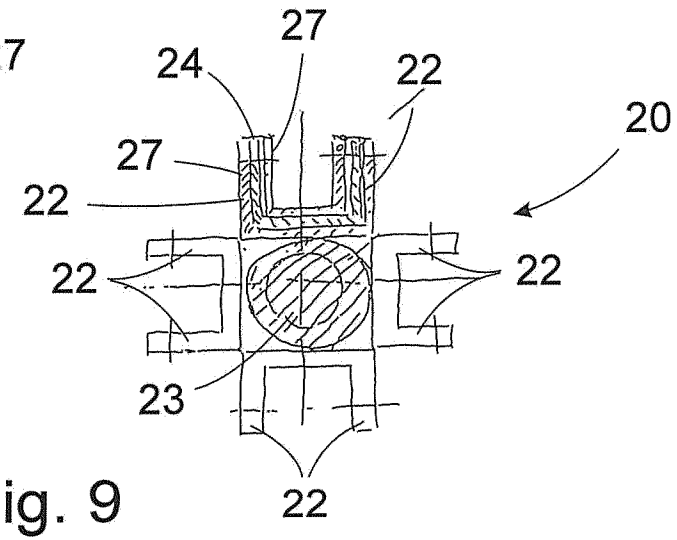
FIG. 9 shows yarn holder of a yarn infeed installation according to a second embodiment.

FIG. 9 shows an alternative embodiment of the yarn infeed installation 20. By contrast to the embodiment described hitherto, not six but a total of eight yarn holders 22 are provided herein, said eight yarn holders 22 being likewise mutually disposed in each case in pairs in a respective U-shape. A total of four pairs of yarn holders 22 are thus present. Otherwise, reference in terms of the functionality and the specific embodiment is to be made to the description already set forth. Three of the pairs of yarn holders 22 are shown purely schematically in FIG. 9.

Figure 10:
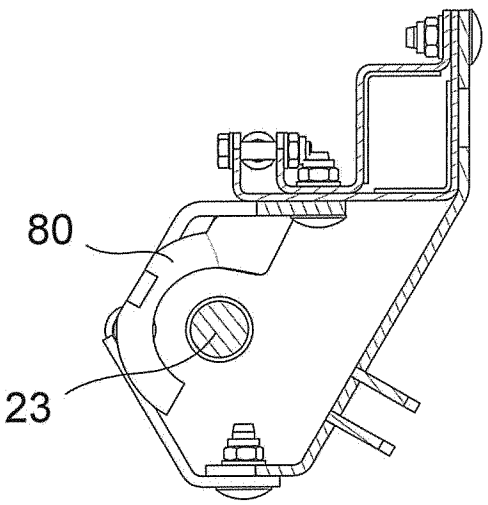
FIG. 10 shows a cross-section through parts of a yarn infeed installation.

FIG. 10 shows a plan view of the opening cam 80. It can be seen herein that the opening cam 80 is embodied so as to be approximately horseshoe-shaped or U-shaped, wherein the guide wheel 26 already described in part of the provided revolution runs on the opening cam 80 and otherwise does not run on the opening cam 80. For example, when the guide wheel 26 is situated in a state in which said guide wheel 26 is not in contact with the opening cam 80, said guide wheel 26 will enable a movement of the movable yarn holder plate 24 toward the opening cam 80.

Such a movement can be triggered in particular by the closing cam 82. Once the guide wheel 26 comes in contact with the opening cam 80 again, the movable yarn holder plate 24 is typically pushed away from the opening cam 80.

Figure 11:
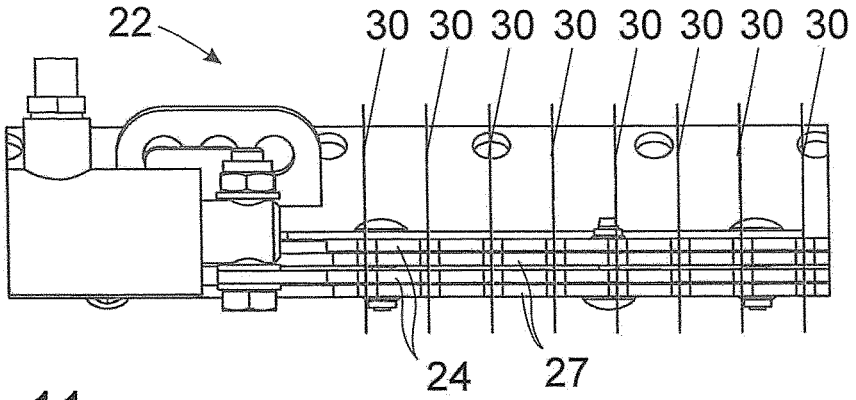
FIG. 11 shows an alternative embodiment of a yarn holder in a first state.

FIG. 11 schematically shows a yarn holder 22 in an alternative embodiment. Not only one movable yarn holder plate 24 is provided herein, but rather two movable yarn holder plates 24 are provided. Said two movable yarn holders 24 are conjointly moved in a coupled manner.

The sequence herein from top to bottom is that first a movable yarn holder plate 24, then a stationary yarn holder plate 27, then again a movable yarn holder plate 24, and then again a stationary yarn holder plate 27 are provided.

FIG. 11 herein shows an opened state, wherein a total of eight yarn strands 30 shown here are also plotted. Said yarn strands 30 run freely through respective recesses in the yarn holder plates 24, 27 such that said yarn strands 30 are not clamped anywhere. This means in particular that the yarn strands 30 along the respective longitudinal direction thereof can be freely moved despite being situated within the yarn holder 22. It is mentioned that any other number of yarn strands can also be used.

Figure 12:
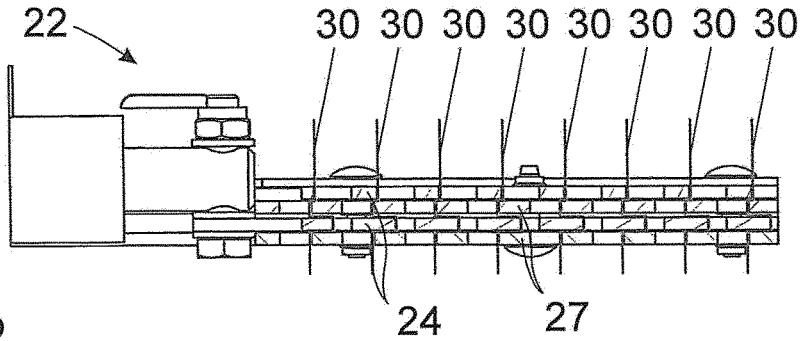
FIG. 12 shows the yarn holder of FIG. 11 in a second state.

By contrast, FIG. 12 shows a state in which the movable yarn holder plates 24 have been displaced to the right. It can be seen herein that the yarn strands 30 have been clamped, specifically between the movable yarn holder plates 24 and the stationary yarn holder plates 27.

The embodiment which is illustrated in FIGS. 11 and 12 and is based on a total of four yarn holder plates 24, 27 has also proven advantageous in comparison to an embodiment having three yarn holder plates. The yarn strands 30 can in particular be clamped in an even more reliable manner.

Figure 13:
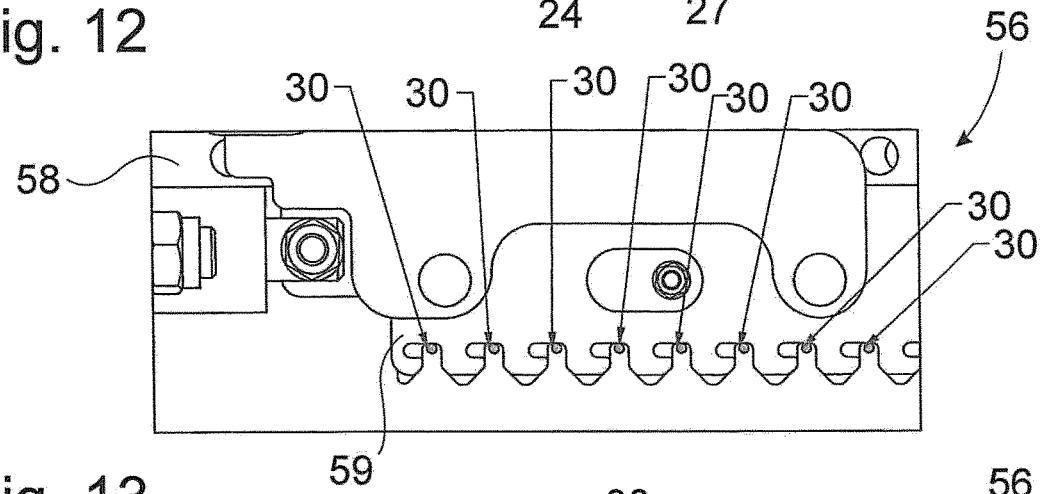
FIG. 13 shows a transport gripper in a first state.
Figure 14:
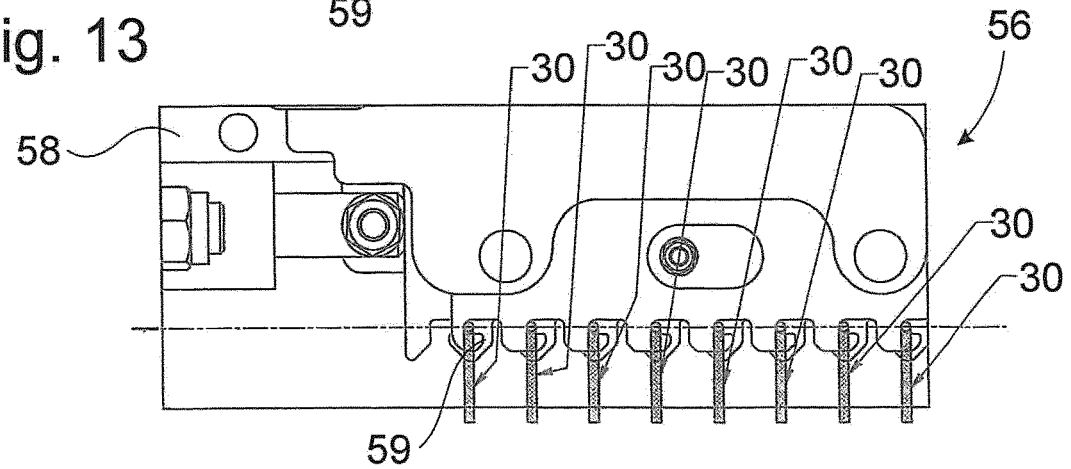
FIG. 14 shows the transport gripper of FIG. 13 in a second state.

FIGS. 13 and 14 separately show the yarn transport gripper 56 having yarn strands 30 continuing therethrough. FIG. 13 herein shows an opened state in which the yarn strands 30 are freely movable along the respective longitudinal direction thereof. FIG. 14 shows a closed state in which the yarn strands 30 are held by the transport gripper 56.

The transport gripper 56 has a first transport gripper plate 58 and a second transport gripper plate 59. Said transport gripper plates 58, 59 are mutually displaceable. The yarn strands 30 can be guided between the transport gripper plates 58, 59 through recesses that are in each case configured wherein said yarn strands 30 in the state illustrated in FIG. 13 are freely movable along the respective longitudinal direction thereof. When the first transport gripper plate 58 is displaced to the right in relation to the stationary second transport gripper plate 59, the yarn strands 30 are clamped between the two transport gripper plates 58, 59. This is illustrated in FIG. 14. For example, this state enables the yarn strands 30 in the pivoting movement of the yarn transport gripper 50 from the right to the left to be conjointly pulled to the left, as has already been described further above, and also new yarn to be unwound from respective yarn packages herein, for example. When yarn portions are to be subsequently inserted, the open state illustrated in FIG. 13 can be assumed again, for example.

Figure 15:
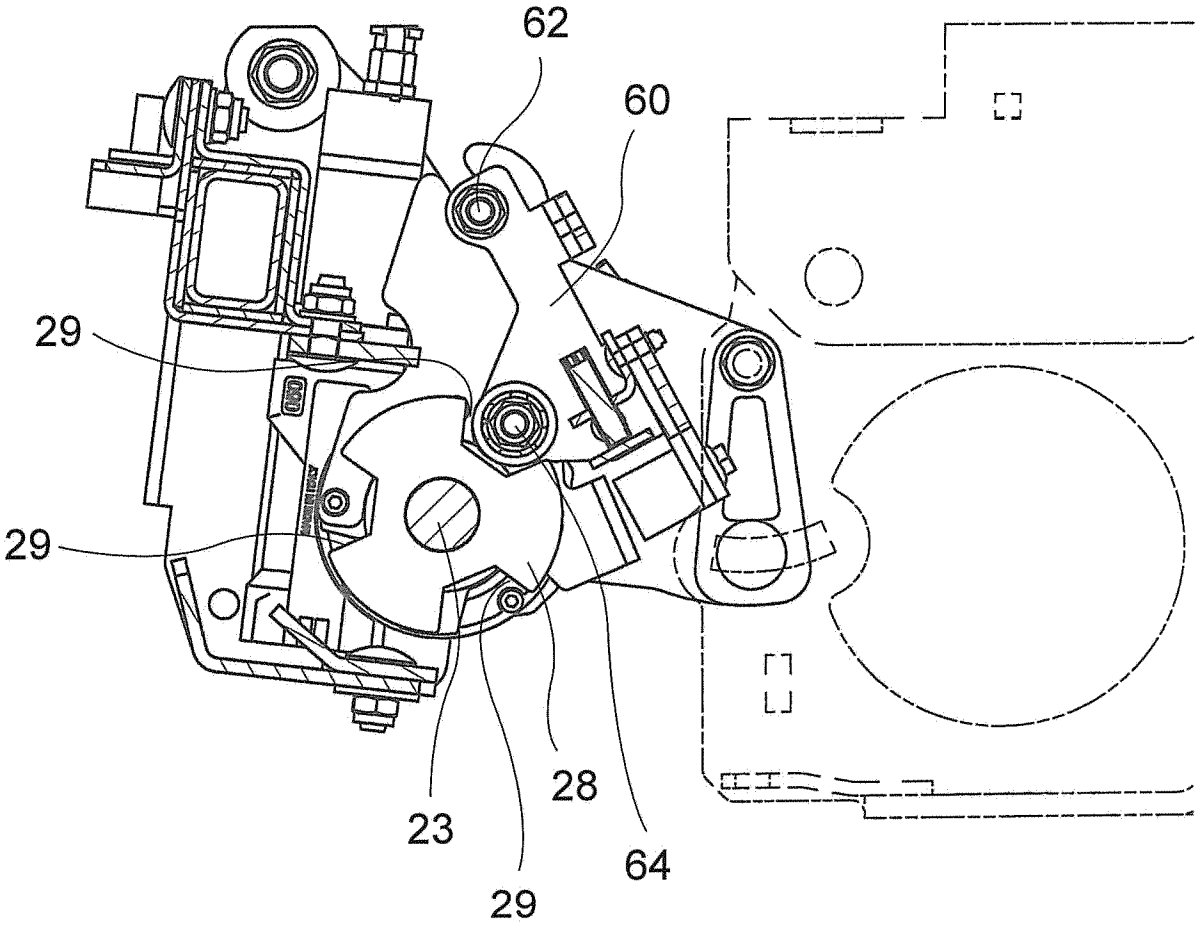
FIG. 15 shows a cutting unit with activation components.

FIG. 15 shows a sectional view through a part of the already mentioned shaft 23 and the cutting unit 60. The pivot axis 62 about which the cutting unit 60 is pivotable is also plotted herein.

The cutting unit 60 has a further ball bearing 64. A nap wheel 28 which is connected to the shaft 23 in a rotationally fixed manner is attached to the shaft 23. The nap wheel in principle thus rotates conjointly with the shaft 23. Three recesses 29 in which the further ball bearing 64 can engage as shown at respective rotary positions of the nap wheel 28 are configured in the nap wheel 28.

When the further ball bearing 64 engages as shown in one of the recesses 29, the cutting unit 60 is thus in an inwardly pivoted position. The latter can be used in particular for a cutting procedure. When the shaft 23 rotates further, the nap wheel 28 is thus also rotated further and thus pushes the further ball bearing 64 outward. On account thereof, the cutting unit 60 is outwardly pivoted such that the latter is spaced apart from the yarn strands 30. This permits the yarn strands 30 to be pulled further, for example.

It is achieved on account of the implementation shown in FIG. 15 that the shaft 23, by way of the nap wheel 28 and the further ball bearing 64, automatically ensures the correct pivoted position of the cutting unit 60.

Figure 16:
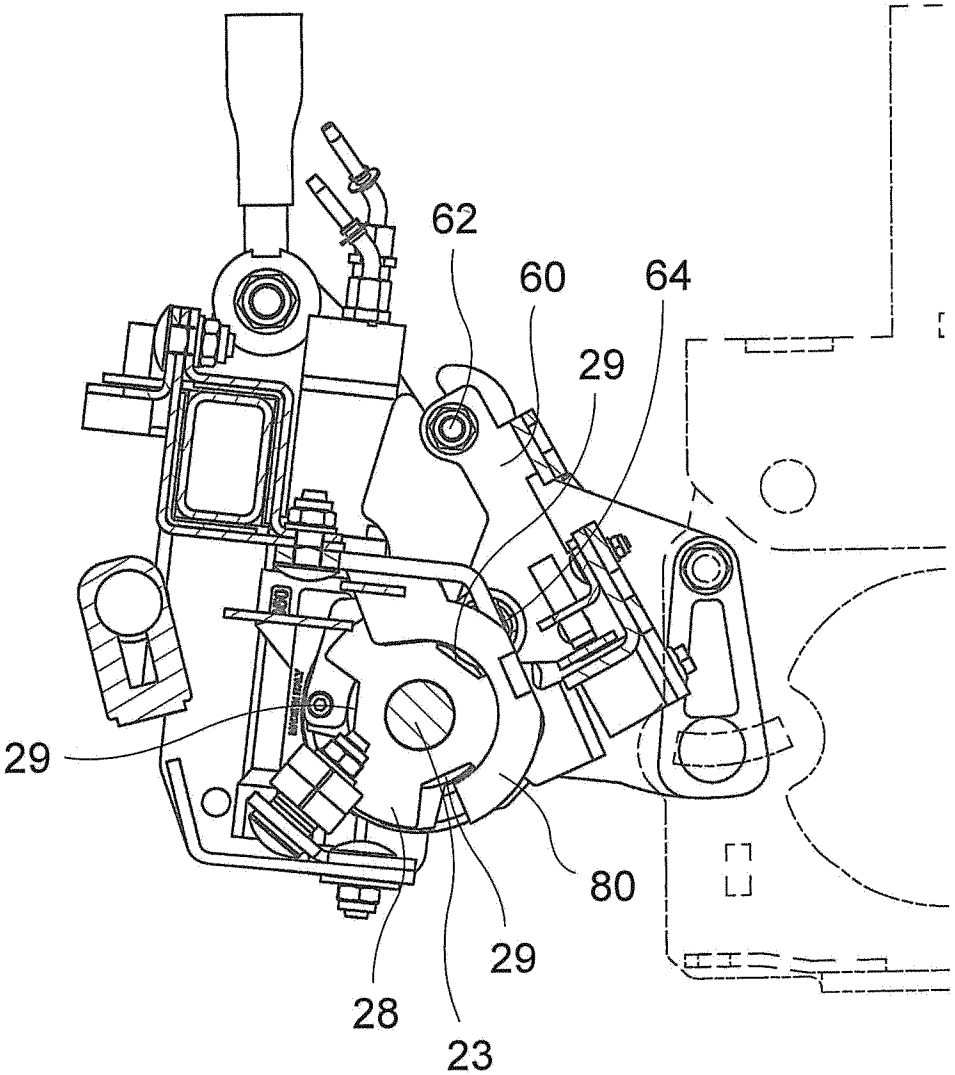
FIG. 16 shows the cutting unit with activation components from FIG. 15 with further components.

FIG. 16 shows a further sectional view, wherein the opening cam 80 can be seen in addition to the components illustrated in FIG. 15. Said opening cam 80 sits in front of the nap wheel 28. The opening cam 80 can be activated as soon as a respective yarn holder 22 has gripped the yarn strands 30. The yarn strands 30 are thus released, and the yarn transport gripper 50 can pull the yarn strands 30 further. Thereafter, the tufting needles 42 in one potential embodiment move downward. The closing cam 82 can subsequently be activated, and the opening cam 80 can thus be retracted. When the tufting needles 42 are moving further downward the shaft 23 can simultaneously be rotated so as to transport the yarn strands 30 to a position at which the yarn transport gripper 50 can again grip the yarn strands 30. In order for the yarn holders 22 to be able to again receive the yarn strands 30, the yarn holders 22 are again opened prior to passing along the deflection 37. This takes place by way of two ball bearings below the opening cam 80. The yarn holders 22 are closed again when running onto the closing cam 82, and the yarn strands 30 are thus jammed.

Summarizing, a potential method sequence can be described as follows:

gripping yarn strands by means of the yarn transport gripper;

releasing the yarn strands in the yarn infeed installation;

pivoting the yarn transport gripper away from the yarn infeed installation, herein disposing the yarn strands below the insertion element;

moving the cutting element to a cutting position;

cutting the yarn strands, herein generating yarn portions;

releasing the yarn portions;

inserting the yarn portions by means of a respective insertion element.

This method sequence can be understood to be an independent aspect of the invention.

Potential features of the proposal are set forth in a structured manner hereunder. The features set forth in a structured manner hereunder can be mutually combined in an arbitrary manner and can be included in the claims of the application in an arbitrary combination. It is evident to the person skilled in the art that the invention is already derived from the subject matter having the fewest features. In particular, advantageous or potential design embodiments, but not the only potential design embodiments, of the invention are set forth hereunder.

The invention comprises:

A tufting unit for a tufting machine, wherein the tufting unit (10) has the following:

a yarn infeed installation (20) for simultaneously feeding a number of yarn strands (30) in parallel;

at least one insertion element (40);

a yarn transport gripper (50) which is configured for transporting a respective free end of the yarn strands (30) away from the yarn infeed installation (20) such that each insertion element (40) is in each case assigned one yarn strand (30);

a cutting unit (60) which is configured for cutting the yarn strands (30) such that, of each yarn strand (30) assigned to an insertion element (40), one yarn portion (35) that is assigned to the respective insertion element (40) remains;

wherein each insertion element (40) is configured for inserting the respective assigned yarn portion (35) into a substrate (12) that is situated below the tufting unit (10).

The afore-mentioned tufting unit, wherein the yarn infeed installation (20) has a plurality of rotating yarn holders (22).

The afore-mentioned tufting unit, wherein the yarn holders (22) are in each case configured so as to interact in pairs such that each yarn strand (30) prior to cutting is held by two yarn holders (22) of one pair.

The afore-mentioned tufting unit, wherein the yarn infeed installation (20) has three or four pairs of yarn holders (22).

The afore-mentioned tufting unit, wherein the yarn transport gripper (50) for gripping the free ends of the yarn strands (30) is configured for gripping respective end portions of the yarn strands (30) which are clamped between two yarn holders (22) of one pair.

The afore-mentioned tufting unit, wherein the yarn infeed installation (20) before each tufting procedure is configured for rotating and/or guiding the yarn holders (22) onward so as to provide new end portions of the yarn strands for gripping by the yarn transport grippers (50).

The afore-mentioned tufting unit, wherein the yarn holders (22) are disposed so as to be rotatable about a common axis (21).

The afore-mentioned tufting unit, wherein each yarn holder (22) has a first yarn holder plate (24, 27) and a second yarn holder plate (24, 27) which for holding and releasing the yarn strands (30) are mutually displaceable.

The afore-mentioned tufting unit, wherein each yarn holder (22) possesses at least one upper, one central, and one lower yarn holder plate (24, 27), and the central yarn holder plate (24) for holding and releasing the yarn strands (30) is displaceable in relation to the two other yarn holder plates by a drive, in particular a hydraulic drive.

The afore-mentioned tufting unit, wherein each yarn holder possesses at least one first, one second, one third, and one fourth yarn holder plate (24, 27), and the second and the fourth yarn holder plates (24) for holding and releasing the yarn strands (30) are displaceable in relation to the two other yarn holder plates (27) by a drive, in particular a hydraulic drive.

The afore-mentioned tufting unit, wherein at least one yarn holder plate (24) by means of a closing cam (82) and an opening cam (80) which are in each case movable by one drive (90), in particular by one hydraulic drive, is displaced relative to the other yarn holder plate (27).

The afore-mentioned tufting unit, wherein the yarn infeed installation (20) releases the yarn strands (30) during transportation.

The afore-mentioned tufting unit, wherein the yarn transport gripper (50) during transportation pulls the yarn strands (30) through the yarn infeed installation (20) and/or unwinds said yarn strands (30) from the respective yarn packages.

The afore-mentioned tufting unit, wherein the tufting unit (10) has an entry-side deflection (37) for guiding the yarn strands (30) ahead of the yarn infeed installation (20).

The afore-mentioned tufting unit, wherein the cutting unit (60) has a cutting blade and an counter blade which for cutting off the yarn portions (35) are mutually displaceable.

The afore-mentioned tufting unit, wherein the cutting blade is displaceable relative to the counter blade by means of a drive, in particular a hydraulic cylinder.

The afore-mentioned tufting unit, wherein each insertion element (40) has one tufting needle (42) which is configured for gripping the respective yarn portion (35) and inserting the latter into the substrate (12).

The afore-mentioned tufting unit, wherein the respective tufting needle (42) is movable vertically and/or perpendicularly to the substrate (12).

The afore-mentioned tufting unit, wherein the tufting unit (10) on the lower side has a tufting plate (70) in which at least one opening (75) for guiding the yarn portion (35) is configured.

The afore-mentioned tufting unit, wherein the tufting unit (10) has at least one needle guide (44) for guiding the tufting needle (42) guiding a respective tufting needle (42), wherein each needle guide (44) with the tufting needles (42) is partially movable, preferably so as to stop short of the substrate or so as to stop short of the tufting plate (70).

The afore-mentioned tufting unit, wherein the insertion element (40), in particular the tufting needles (42), during the movement thereof unwind/unwinds the yarn strands (30) from the respective yarn packages.

The afore-mentioned tufting unit, wherein the yarn transport gripper (50) is mounted to as to be pivotable on a pivot point (52).

The afore-mentioned tufting unit, wherein the tufting unit (10) has an activatable bar (54) for pivoting the yarn transport grippers (50).

The afore-mentioned tufting unit, wherein the bar (54) is activatable hydraulically or by a crank mechanism.

The afore-mentioned tufting unit, wherein the yarn transport gripper (50) has a transport gripper (56) for gripping the free ends of the yarn strands (30).

The afore-mentioned tufting unit, wherein the transport gripper (56) has a first transport gripper plate (58) and a second transport gripper plate (59) which for gripping and releasing the free ends are mutually displaceable, in particular by a hydraulic drive.

The afore-mentioned tufting unit, wherein the yarn transport gripper (50) is configured for releasing the yarn portions (35) during inserting.

The afore-mentioned tufting unit, wherein the cutting unit (60) is pivotably mounted.

The afore-mentioned tufting unit, wherein the cutting unit (60) prior to a respective cutting procedure is configured for being pivoted toward the yarn strands (30), and after the cutting procedure is configured for being pivoted away from the yarn strands (30).

The afore-mentioned tufting unit, furthermore having a setting device for the terminal position of the yarn transport gripper (50) and/or the position the of cutting installation (60).

The afore-mentioned tufting unit, furthermore having a depth setting device for the penetration depth of the tufting needle into the substrate.

A tufting machine for inserting into a substrate (12) that is situated below the tufting unit (10) in each case one yarn portion from a yarn strand (30) that is in each case positioned and cut off by a tufting unit (10), in particular a tufting unit (10) as mentioned above.

A tufting machine having a tufting unit as mentioned above.

The afore-mentioned tufting machine, wherein the yarn transport grippers (50), preferably in an alternating pivoting movement, transport in each case the end portions of the yarns that are kept ready by the yarn infeed installation (20) away from the yarn infeed installation (20), wherein the yarn transport grippers (50) assign and position the respective yarn strand to in each case one insertion element (40), and once the cutting unit (60) has cut off the respective yarn portions (35) from the respective yarn strands (30), the insert element (40) inserts the respective yarn portions (35) into the substrate (12).

The claims filed now together with the application and filed later are without prejudice in terms of achieving wider protection.

Should closer examination, in particular also of the relevant prior art, herein indicate that one or the other feature is indeed favorable but not decisive in terms of the objective of the invention, a wording which no longer includes such a feature, in particular in the main claim, is of course envisaged already at this stage. Such a sub-combination is also covered by the disclosure of this application.

It is furthermore be noted that the design embodiments and variants of the invention described in the various embodiments and shown in the figures can be mutually combined in an arbitrary manner. Individual features or a plurality of features herein can replace one another in an arbitrary manner. Said combinations of features are likewise included in the disclosure.

The back-references set forth in the dependent claims relate to the further configuration of the subject matter of the main claim by way of the features of the respective dependent claim. However, said back-references are not to be understood as a waiver in terms of achieving an independent objective protection for the features of the back-referenced dependent claims.

Features which have been disclosed only in the description, or else individual features from claims which comprise a plurality of features, may at any time be assumed by the independent claim/claims as being of significance relevant to the invention for delimiting the latter from the prior art, specifically also when such features have been mentioned in conjunction with other features, or achieve particularly favorable results in conjunction with other features.

The invention claimed is:

1. Tufting unit for a tufting machine, wherein the tufting unit has the following:

a yarn infeed installation for simultaneously feeding a number of yarn strands in parallel, wherein said yarn infeed installation unwinds the yarn strands from respective yarn packages during the feeding of the yarn strands;

at least one insertion element;

a yarn transport gripper which is configured for transporting a respective free end of the yarn strands away from the yarn infeed installation such that each insertion element is in each case assigned one yarn strand, wherein said yarn transport gripper pulls the yarn strands through the yarn infeed installation and unwinds the yarn strands from the respective yarn packages; and a cutting unit which is configured for cutting the yarn strands such that, for each yarn strand assigned to an insertion element, one yarn portion that is assigned to the respective insertion element remains, wherein each insertion element is configured for inserting the respective assigned yarn portion into a substrate that is situated below the tufting unit, and wherein the insertion element, during movement thereof, unwind/unwinds the yarn strands from the respective yarn packages.

2. Tufting unit according to claim 1, characterized in that the yarn infeed installation has a plurality of rotating yarn holders.

3. Tufting unit according to claim 2, characterized in that the yarn holders are in each case configured so as to interact in pairs such that each yarn strand prior to cutting is held by two yarn holders of one pair.

4. Tufting unit according to claim 2, characterized in that the yarn infeed installation before each tufting procedure is configured for at least one of rotating and guiding the yarn holders onward so as to provide new end portions of the yarn strands for gripping by the yarn transport gripper.

5. Tufting unit according to claim 2, characterized in that the yarn holders are disposed so as to be rotatable about a common axis.

6. Tufting unit according to claim 1, further comprising, at least one yarn holder plate, including a closing cam and an opening cam which are each movable by one drive, so as to be displaced relative to the other yarn holder plate.

7. Tufting unit according to claim 1, characterized in that each insertion element has one tufting needle which is configured for gripping the respective yarn portion and inserting the one tufting needle into the substrate.

8. Tufting unit according to claim 1, characterized in that the tufting unit, on a lower side thereof, has a tufting plate in which at least one opening for guiding the yarn portion is configured.

9. Tufting unit according to claim 1, characterized in that the tufting unit has at least one needle guide for guiding the tufting needle or for guiding a respective tufting needle, wherein each needle guide with the tufting needle, or with the respective tufting needle, is partially movable.

10. Tufting unit according to claim 1, characterized in that the yarn transport gripper is mounted so as to be pivotable on a pivot point.

11. Tufting unit according to claim 10, characterized in that the yarn transport gripper is configured for releasing each yarn portion, respectively, during inserting.

12. Tufting unit according to claim 1, characterized in that the cutting unit is pivotably mounted, wherein the cutting unit prior to a respective cutting procedure, is configured for being pivoted toward the yarn strands, and after the cutting procedure, is configured for being pivoted away from the yarn strands.

13. A tufting machine for inserting into a substrate that is situated below the tufting unit, wherein each yarn portion from the yarn strand, respectively, is positioned and cut off by the tufting unit according to claim 1.

14. Tufting unit according to claim 6, wherein the one drive comprises a hydraulic drive.

15. Tufting unit according to claim 9, wherein each needle guide is partially movable so as to stop short of the substrate or so as to stop short of the tufting plate.

16. Tufting unit according to claim 1, wherein the tufting needles, during the movement thereof, unwind the yarn strands from each of the respective yarn packages.

17. Tufting unit according to claim 1, characterized in that the yarn transport gripper is configured for releasing each yarn portion, respectively, during inserting.

18. Tufting unit according to claim 2, characterized in that the yarn transport gripper is configured for releasing each yarn portion, respectively, during inserting.

* * * * *